US008529032B2

(12) United States Patent
Indorsky et al.

(10) Patent No.: US 8,529,032 B2
(45) Date of Patent: Sep. 10, 2013

(54) DEGASSING INK IN DIGITAL PRINTERS

(75) Inventors: Dennis Indorsky, Netanya (IL); Arnon Gani, gan-Yavne (IL); Gil Fisher, Shoham (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 655 days.

(21) Appl. No.: 12/524,655

(22) PCT Filed: Jan. 28, 2008

(86) PCT No.: PCT/US2008/052188
§ 371 (c)(1),
(2), (4) Date: Aug. 24, 2009

(87) PCT Pub. No.: WO2008/094859
PCT Pub. Date: Aug. 7, 2008

(65) Prior Publication Data

US 2010/0085405 A1 Apr. 8, 2010

(30) Foreign Application Priority Data

Jan. 31, 2007 (GB) ..... 0701773.4

(51) Int. Cl.
*B41J 2/175* (2006.01)

(52) U.S. Cl.
USPC ..... 347/86

(58) Field of Classification Search
None
See application file for complete search history.

(56) References Cited

U.S. PATENT DOCUMENTS

| | | | | |
|---|---|---|---|---|
| 6,234,621 | B1 * | 5/2001 | Musser et al. | 347/92 |
| 7,118,204 | B2 * | 10/2006 | Hatasa et al. | 347/86 |
| 7,344,230 | B2 * | 3/2008 | Moynihan | 347/85 |
| 2002/0158950 | A1 | 10/2002 | Altendorf | |
| 2004/0104950 | A1 | 6/2004 | Nakamura | |

FOREIGN PATENT DOCUMENTS

WO 2006029236 3/2006

OTHER PUBLICATIONS

PCT International Search Report for Application No. PCT/US2008/052188, filed Jan. 28, 2008. ISR issued May 29, 2008.

* cited by examiner

*Primary Examiner* — Matthew Luu
*Assistant Examiner* — Erica Lin

(57) ABSTRACT

A method of degassing ink in a printer having an ink storage tank containing a body of ink having an ink surface is described. The method comprises causing the body of ink to move in the storage tank, so as to increase the surface area of the ink surface in comparison with a flat ink surface that an equivalent stationary body of ink would have in the storage tank, and extracting gas from the ink body.

6 Claims, 3 Drawing Sheets

DEGASSING INK IN DIGITAL PRINTERS

The present invention relates to degassing liquid ink in a digital printer having an ink storage tank or reservoir, and particularly, but not exclusively, in an inkjet printer. Most particularly, but not exclusively, the invention relates to degassing ink in an inkjet printer having piezo-electric print heads.

Inkjet printing is a printing method well known in the art. The basics of this technology are described, for example by Jerome L. Johnson "Principles of Non-impact Printing", Palatino Press, 1992, Pages 302-336. ISBN 0-9618J05-2-6. Applications using inkjet printing include home computer printers, large format graphics printers, commercial and industrial printers, as well as other technologies such as materials deposition.

Recently inkjet printing has gained popularity in a number of industrial applications. One of the growing industrial printing applications is printing of billboards, banners and point of sale displays. The inkjet printing process involves manipulation of droplets of ink ejected from a nozzle or a number of nozzles of a print head onto an adjacent print substrate. Paper, cardboard, plastics, vinyl, textiles, fabrics, are examples of print substrates, although inkjet printing is not limited to those substrates. Microscopic ink channels conduct ink to the nozzle or nozzles, and the whole structure forms a print head. Piezo electric print heads are typically employed in industrial printers. They eject ink droplets through the nozzles by compressing or changing the volume of the ink in ink conducting channels. Presence of gas in an ink-conducting channel results a faulty nozzle operation.

The ink system of an ink jet printer is usually an airtight system, but air can often get into the system when ink is replenished. In order to avoid problems associated with bubbles of gas in the ink, ink supplied to piezo-electric print heads is degassed. Degassing is a process that extracts dissolved gas from a liquid, in this case, ink. "Gas" in the context of the present disclosure means a gas dissolved or entrained in liquid ink, and includes, but is not limited to, air.

One way of degassing ink is to extract gas from ink in an ink flow path, while ink is being conducted from an ink supply, such as a storage tank, to the print heads. Ink may be passed through a porous tube, allowing air bubbles from the ink to pass through the walls of the tube, degassing the ink. Another way of degassing ink involves heating the ink in order to encourage the release of gas bubbles from the ink. Another way of degassing ink is to add a chemical to the ink. Some of the techniques extract gas from the ink in a location close to or at the print head.

Industrial ink jet printers cover large surfaces with ink and consume large amounts of ink. The exact ink consumption is difficult to predict, since in addition to the act of printing consuming ink, print head maintenance cycles are conducted concurrent to printing. Accordingly, almost all industrial printers have a large fixed ink tank from which, during the course of printing, smaller interim ink tanks located close to print heads, and in some cases moving with print heads, can be refilled.

According to a first aspect the invention comprises a method of degassing ink in a printer having an ink storage tank containing a body of ink having an ink surface, said method comprising the steps of:

causing said body of ink to move in said storage tank, so as to increase the surface area of the ink surface in comparison with a flat ink surface that an equivalent stationary body of ink would have in said storage tank; and extracting gas from said ink body.

The ink surface is adjacent to an ink storage tank atmosphere. In this context, 'atmosphere' is used to mean the gas in the portion of the storage tank above the body of ink that is substantially free of ink. The atmosphere may comprise gas at a pressure below atmospheric pressure, and may comprise a vacuum.

The method may comprise applying a vacuum to the ink storage tank.

The body of ink may have a non-flat but stable, surface area exposed to the atmosphere. For example, the ink may be caused to move in a rotational path around an axis within the ink storage tank, so as to increase the surface area of the ink, for example by creating a vortex of ink. The surface area of the ink is increased as centrifugal forces cause the ink to move away from a centre of the tank. In addition to increasing the surface area of the body of ink, centrifugal forces assist separation of ink from gas by encouraging gas to move towards, or remain close to, the centre of the storage tank.

Ink may be caused to move in a rotational path by a rotating object. The rotating object may be a magnetic element caused to move by a rotating magnetic field.

Ink may be caused to move in a rotational path by injecting ink into the storage tank offset from a central axis of the tank. The ink may be injected into the storage tank at a tangent to a wall of the tank. The ink that is injected may supplied from an outlet of the storage tank. The outlet may be in a base of the ink storage tank.

The ink storage tank may comprise a substantially circular cross section. In some embodiments, ink moves within the storage tank in a substantially circular path.

According to a further aspect of the invention we provide a liquid ink printer comprising an ink storage tank, and an ink mover adapted to force ink to move within the storage tank so as to increase a surface area of the ink from which gas can escape the ink.

The printer may also comprise a gas extractor for extracting gas from the ink. The gas extractor may comprise a vacuum generator adapted to reduce the pressure within the ink storage container to a pressure below atmospheric pressure.

Embodiments of the invention will now be described, by way of example only, with reference to the accompanying drawings. The drawings are not necessarily to scale, and are intended to illustrate the principles of the method.

Figure 1A:
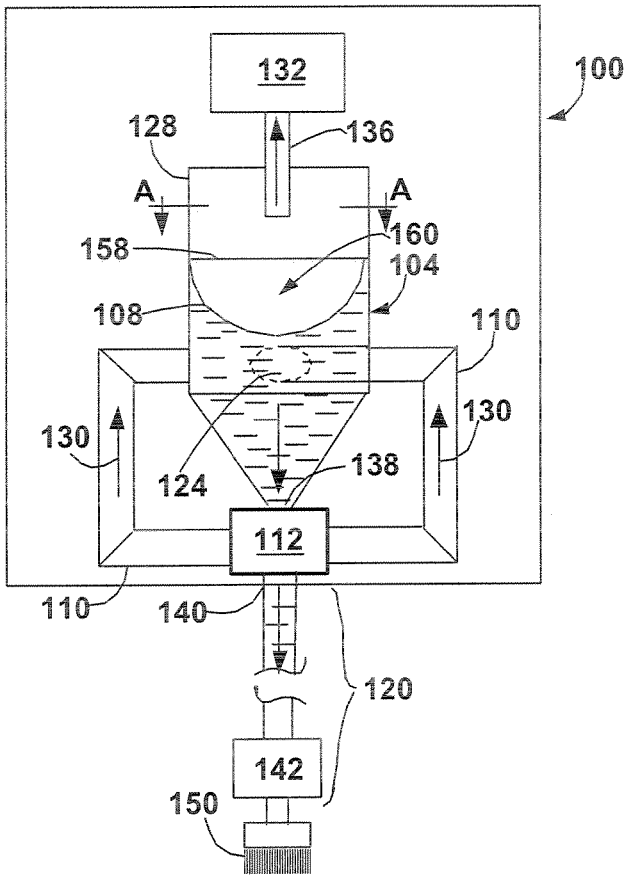
FIGS. 1A and 1B are respectively schematic illustrations of elevation cross sectional and a plan view of an exemplary embodiment of the ink degassing apparatus.
Figure 2A:
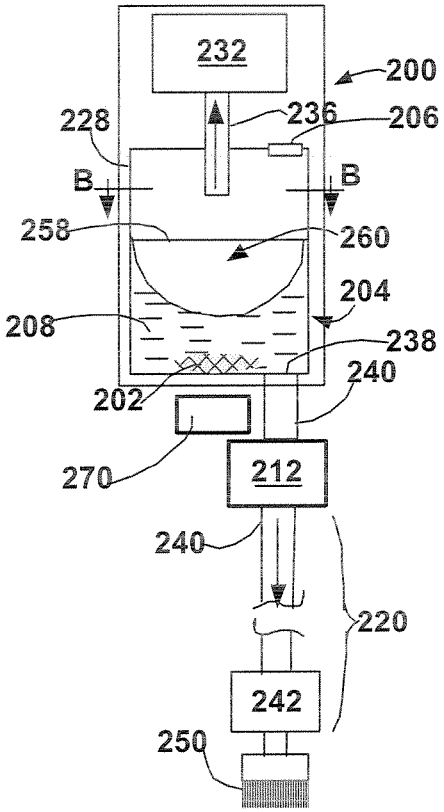
FIGS. 2A and 2B are respectively schematic illustrations of an elevation cross sectional view and a plan view of another exemplary embodiment of the ink degassing apparatus.
Figure 2B:
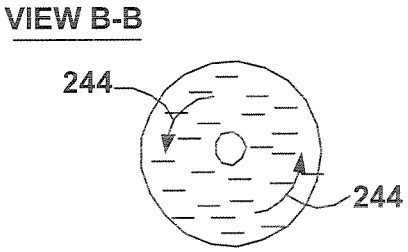
Figure 3:
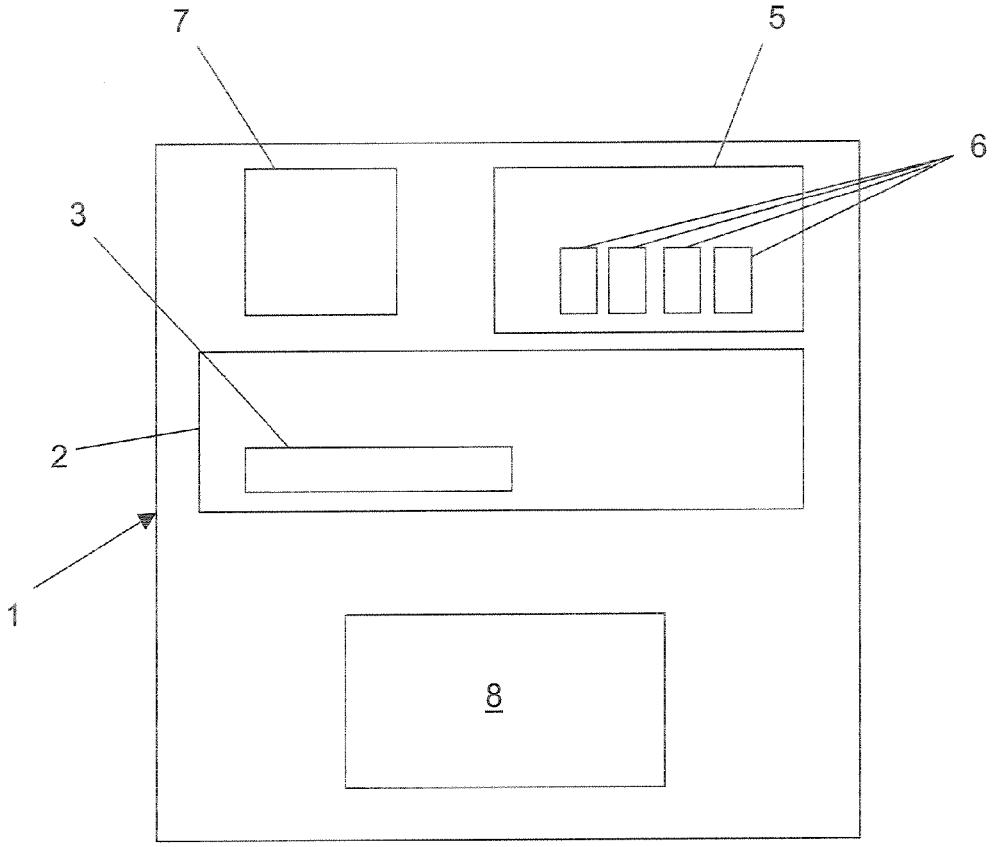
FIG. 3 shows a schematic perspective view of a printer comprising ink degassing apparatus.

A printer 1 is shown in FIG. 3 having a paper feed mechanism 2 adapted to maneuver sheets of paper 3, past a print head station 5. The print head station 5 has several piezo-electric elect inkjet printer heads each with a local reservoir 6 of ink. A large liquid ink reservoir tank 7 feeds each local reservoir 6. In some embodiments the tank 7 has a volume of about 1-10 litres, for example about 2 litres, or about 5 litres, or about 8 litres, or about 1 litre or 10 litres. The tanks 7 have an ink degassing apparatus, as described in relation to FIGS. 1A to 2B. A processor 8 controls the operation of the printer 1.

The printer is capable of printing on rolls of web material, for example paper, or plastic material. The rolls of material are usually cut to size after printing. The rolls in this particular embodiment are 5 metres wide (but in other embodiments the rolls can be other widths). The printer is in this embodiment a wide format printer about 8 metres long and about 2 metres high (in other embodiments printers of different sizes are envisaged). The printer in this embodiment prints out about 100-400 dpi, but other print resolutions are also envisaged.

Figure 1B:
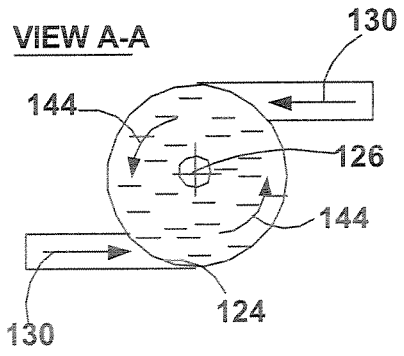

FIG. 1 is a schematic illustration of one embodiment of an ink degassing apparatus. Ink degassing apparatus 100 consists of a fixed ink storage means, in this case a tank 104. The tank 104 has a substantially circular cross section, as shown in FIG. 1B, and comprises a cylindrical upper portion tapering to a lower conical portion. The tank is part-filled with ink 108, but comprises a headspace or atmosphere above the ink, that is substantially free of ink (except perhaps for some ink droplets).

The apparatus 100 further has a gas extractor, in this case a vacuum generator 132, which may for example be a blower or a vacuum pump, communicating with the headspace of the tank 104 through tubing 136.

An electric pump 112 is provided for pumping ink 108 into and out of tank 104 via tubes 110. A portion of each tube 110 adjacent the tank 104 is arranged tangential to a wall 128 of the tank. Pump 112 supplies ink 108 into tank 104 through one or more inlets 124 in the tank wall 128, below the surface of the ink 108. Pump 112 is also adapted to deliver ink into an ink delivery system 120 schematically shown by ink delivery tube 140 and ink tanks 142. Alternatively, an additional pump may be used to supply ink into ink system 120 if required, rather than pump 112. The ink delivery system 120 delivers ink to print heads 150. Ink delivery tube 140 is in fluid communication with tank 104 and ink delivery system 120 and enables ink 108 to be delivered through ink system 120 to the smaller interim tanks 142 and print heads 150, as is well known.

The operation of the exemplary ink degassing apparatus will now be described. In use, pump 112 pumps ink through tubes or injector channels 110, to create two symmetrically disposed streams of ink flowing into the tank 104 tangential to tank wall 128. This movement of ink is shown schematically by arrows 130 in FIGS. 1A and B. The streams of ink 130 force ink 108 in tank 104 to move and circulate in a rotational movement pattern shown by arrows 144 (FIG. 1B). It will be appreciated that any number of streams, including one, three, four five, etc, could be used besides two, given an appropriate number of tubes 110. An even number of streams may be helpful in equalizing forces about a central axis of the tank 104.

The throughput of pump 112 sets the rotational speed of ink 108, which might be in the range 10 to 200 revolutions per minute (rpm). In some embodiments the rotational speed is from the group: about or of the order of 10 rpm; about or of the order of 50 rpm; about or of the order of 100 rpm; about or of the order of 150 rpm; about or of the order of 200 rpm. The faster the ink 108 rotates the faster the ink degassing in tank 104.

It should be noted that a rotational movement pattern 144 shown in FIG. 1B, might be imposed on ink 108 by a stream of ink 130 that is offset with respect to central axis 126 of tank 104 (but not longentional), although stream 130 is most effective at a largest possible offset. In addition, the stream could be injected into the ink tank 104 at any angle, as long as the stream of ink is not injected directly towards the central axis 126.

The rotational movement of ink 108 forms a non-flat shaped, curved, funnel-like (vortex-like) ink boundary surface 160 beneath the headspace. This is in contrast to the flat upper ink surface that the static ink 108 would have if the body of ink were not rotating. The surface area of ink surface 160 is larger than the flat surface of static ink, which would be no larger than the cross sectional area of the ink storage tank 104 at the point where the body of the ink meets the atmosphere above it. This larger surface area means that there is a larger surface through which gas can escape from the body of ink 108, thus speeding up separation of gas from the ink.

Furthermore, under the influence of centrifugal forces generated by the rotational movement pattern 144 of ink 108, gas dissolved in ink 108 tends to move to the center of tank 104 whereas heavier ink 108 tends to move closer to walls 128 of tank 104, and some gas is separated from the ink in this way.

The vacuum generator 132 maintains a pressure below atmospheric pressure in tank 104. The pressure within the tank might be in the range 0.75-0.9 bar, but other pressures are also envisaged. A lower pressure facilitates gas from ink separation, by encouraging gas to bubble out of the ink due to the difference in pressure between the ink and the headspace. Vacuum generator 132 evacuates gas extracted from ink 108 from tank 104 through tube 136.

The same ink is repeatedly pumped out of and back into tank 104, in a 'closed loop'. That is, ink is drawn from the base of the tank through outlet 138, and injected back into the tank through inlets 124. It will be appreciated that this need not be the case, and that new ink might be pumped into the tank 104 through inlets 124, rather than recycled ink.

Recycling ink from the bottom of the tank is advantageous, because ink at the bottom of the tank is far from the ink surface, and so takes longest to degas, while surface ink degasses fairly quickly, even in static ink. If ink from the bottom of the tank is encouraged to move towards the top of the tank, the entire body of ink 108 degasses far more quickly than if ink were allowed to remain at the bottom. Thus continuously injecting new portions and layers of the same ink 108 into tank 104 using pump 112 further facilitates dissolved gas extraction. Stirring the ink using streams 130 also helps bring ink from the bottom of the tank 104 closer to the ink surface 160, and helps ensure more uniformity the properties (e.g. viscosity, composition, and gas dissolved in the ink) of the ink. The inlets 124 are shown approximately half way up the wall 128 of the tank. However they might be located at any position on the wall that is below the surface of the ink when the ink is being stirred.

FIGS. 2A and 2B schematically illustrate another exemplary embodiment of an ink degassing apparatus. Apparatus 200 consists of an ink tank 204 communicating with a vacuum generator 232 through a tube 236 and having an opening 206 through which a certain amount of ink 208 is introduced into tank 204. Tank 204 communicates with an ink delivery system 220 through a tube 240. An impellor, which is a rotating object, or stirrer, which in this case is a magnetic element or article 202, is positioned at the bottom of ink tank 204. Other stirrers could be a rotating vane or paddle. A stirrer control, in this case an electrically controlled rotating magnetic field, schematically shown by block 270, in use causes element 202 to rotate, and so forces ink 208 to move in a rotational pattern. Centrifugal forces, and increased boundary surface area 260, encourage the separation of gas from the body of ink, as described with reference to FIGS. 1A and B. The speed of rotation of article 202 sets the rotational speed of ink 208 and accordingly the speed of ink degassing. The stirring action continuously fetches portions and layers of ink 208 from near the bottom of the tank to closer to surface 260 and assists in accelerating the ink degassing process.

Vacuum generator 232 keeps tank 204 at a pressure below atmospheric and encourages separation of gas from ink as well as evacuating extracted gas from the tank 204 atmosphere 258 through tubing 236, in the same way as described with reference to FIGS. 1A and B. Pump 212 delivers degassed ink 208 into a transfer ink system 220 and to print heads 250.

Ink degassing is performed in either embodiment in a continuous mode at intervals. A degassing cycle can be run regularly, for example, every ten, twenty, thirty, forty minutes or so. Alternatively, ink could be degassed before or during every print cycle. Printing may continue until the ink is depleted and the empty tank needs to be filled with a body of ink, or ink in the storage tank may be replenished (e.g. gradually replenished) as it is depleted. It may be desirable to run a degassing cycle immediately or soon (30 seconds, or a minute or two) after new ink is introduced into the storage tank. Each degassing cycle may be of fairly short duration, for example 10, 20, 30, 40, or 50 seconds, or for one or two minutes or more. Alternatively, the ink degassing process could run continuously. Degassing might be automatically controlled by the processor, or might be performed when the processor is instructed to perform a degassing operation by a user via an input 9 (FIG. 3).

The stirrer control might be an electric motor moving a magnet, or a switched electrical current may create a rotating magnetic field for a non-magnetic stirrer. Either embodiment is simple to achieve using conventional electronic circuitry.

Embodiments of the invention do not require special ink-gas exchange materials to be utilized in the ink degassing process. Embodiments of the invention can have a relatively low cost the ink delivery system, as a degassing apparatus is not needed in the ink delivery system, and so this reduces the cost of the inkjet printer. The method works effectively to degas ink and hence reduces the number of faulty nozzles and improves print quality due to a low gas bubble concentration in the ink delivered to the print head.

While in both embodiments described above the ink has been caused to move in a rotational path or pattern so as to increase the surface area through which gas can escape from the ink, it will be appreciated that the ink need not move in a rotational pattern. Rather, the ink might be caused to move in any manner that increases its upper surface area. For example, waves might be created in the ink, but rotational movement is simple to achieve and is our preferred route.

The invention claimed is:

1. A liquid ink printer comprising:

an ink storage tank having a plurality of holes around a circumference of the ink storage tank, the ink storage tank tapering towards a bottom of the ink storage tank;

a plurality of tubes, each tube having a first end fluidically connected to a corresponding hole of the holes around the circumference of the ink storage tank and having a second end;

an ink mover configured to cause a body of ink to move within the ink storage tank so as to create a non-flat curved upper surface of the body of ink and configured to cause the body of ink to rotate about a fixed axis within the ink storage tank without using an impeller, the ink mover comprising a recirculating pump disposed at the bottom of the ink storage tank and fluidically connected to the second ends of the tubes to recirculate the body of ink from the bottom of the ink storage tank back into the ink storage tank through the tubes; and a gas extractor for extracting gas from the ink.

2. The printer of claim 1 wherein the gas extractor comprises a vacuum generator configured to reduce the pressure within the ink storage tank to a pressure below atmospheric pressure.

3. The printer of claim 1 wherein the ink mover comprises an ink circulator to create a vortex of ink within the ink storage tank to promote rotation of the body of ink about the fixed axis within the ink storage tank.

4. The printer of claim 3 wherein the ink mover further comprises an ink injector channel tangentially fluidically connected to the ink storage tank at a plurality of positions around a perimeter of the ink storage tank to inject a corresponding plurality of jets of ink into the body of ink below the upper surface of the body of ink to further promote the rotation of the body of ink about the fixed axis within the ink storage tank.

5. The printer of claim 4 wherein said injected ink is supplied from an outlet in a base of said ink storage tank.

6. The printer of claim 3 wherein the ink storage tank is cylindrical.

* * * * *